US008240531B2

(12) United States Patent
Lam

(10) Patent No.: US 8,240,531 B2
(45) Date of Patent: Aug. 14, 2012

(54) BACKPACK WITH AN INTELLIGENT AUTOMATIC ADJUSTING INFLATION AIRCUSHION AND A PNEUMATIC SHOCK ABSORBER SYSTEM

(75) Inventor: Hon Hung Ricky Lam, Shenzhen (CN)

(73) Assignee: Ricky Hon Hung Lam, Liu Yue, Hengguang, Longgang, Shenzhen (CN)

( * ) Notice: Subject to any disclaimer, the term of this patent is extended or adjusted under 35 U.S.C. 154(b) by 89 days.

(21) Appl. No.: 12/744,327

(22) PCT Filed: Nov. 20, 2009

(86) PCT No.: PCT/CN2009/075055

§ 371 (c)(1), (2), (4) Date: Aug. 23, 2010

(87) PCT Pub. No.: WO2010/057441

PCT Pub. Date: May 27, 2010

(65) Prior Publication Data

US 2010/0308095 A1 Dec. 9, 2010

(30) Foreign Application Priority Data

Nov. 21, 2008 (CN) ..... 2008 1 0219275

(51) Int. Cl.
*A45F 3/04* (2006.01)

(52) U.S. Cl. ..... 224/631; 224/644

(58) Field of Classification Search ..... 224/627, 224/631, 633, 644

See application file for complete search history.

(56) References Cited

U.S. PATENT DOCUMENTS 7,931,178 B2 * 4/2011 Rome et al. ..... 224/634
7,946,460 B2 * 5/2011 Yip ..... 224/631
7,997,466 B2 * 8/2011 Fidrych et al. ..... 224/634

FOREIGN PATENT DOCUMENTS

CN 201079122 Y * 7/2008
JP 2003305416 A * 10/2003

* cited by examiner

*Primary Examiner* — Justin Larson

(57) ABSTRACT

The present invention relates to the field of backpack technology, and more particularly to a backpack with an intelligent automatic adjusting inflation aircushion and a pneumatic shock absorber system, which comprising: a backpack main body and a shoulder strap and back cushion; the backside of said backpack main body is installed with a back frame; said shoulder strap and back cushion is provided with said adjustable inflation aircushion; the backside of said shoulder strap and back cushion is provided with said pneumatic shock absorber system; said pneumatic shock absorber system can be movably connected with said back frame. Said pneumatic shock absorber system of the present invention can effectively reduce the vibration generated during the usage of the said backpack, while the smart connection between said pneumatic shock absorber system and said adjustable inflation aircushion can automatic adjust air pressure of said inflation aircushion inside said shoulder strap and back cushion according to the number of the load of said backpack. Hence, an optimum softness of said shoulder strap and back cushion is achieved and, as a result, the user will feel more comfortable and can effectively avoid the harm generated from the weight of backpack to his body.

6 Claims, 3 Drawing Sheets

BACKPACK WITH AN INTELLIGENT AUTOMATIC ADJUSTING INFLATION AIRCUSHION AND A PNEUMATIC SHOCK ABSORBER SYSTEM

FIELD OF THE INVENTION

The present invention relates to the field of backpack technology, and more particularly to a backpack with an intelligent automatic adjusting inflation aircushion and a pneumatic shock absorber system.

BACKGROUND

Backpacks are more widely used in our daily lives, wherever in the activities like going to school, traveling, mountain-climbing, or going out commerce and trade. Generally, the traditional backpacks are just paid attention to the loading function, such as how many bags does the backpack have, how many stuff can be packed or whether the backpack looks good, these factors are considered much in the backpack designing or purchasing. However, the comfort and safety of backpacks are not took into consideration much.

Traditionally for our habits, we always like to pack stuff as many as possible into the backpack. While in the actual application, the shoulder, waist, neck, back and other parts of our body suffer different levels of strain because the body is bearing overload for a long time. If this problem can not be solved in long time, our health would be undermined irreparably. Thus, a kind of backpack which is more comfortable while can minimize the harm to human body as possible is desired to turn up.

To solve the above problems, a buffering device is provided on the basis of the present backpacks, such as an aircushion is installed in the back or the shoulder straps of the backpack. But the inflation extent of the aircushion secured with the backpack is constant, it conduces the buffering device become useless as long as the backpack is broken, and the waste of resource. Additionally, the property of un-adjustable of the aircushion's inflation extent makes the buffering effect and the comfort it brought worse to some extent.

SUMMARY OF THE INVENTION

The objective of the present invention is to overcome the defect of the prior act, and to provide a backpack with an intelligent automatic adjusting inflation aircushion and a pneumatic shock absorber system, while the backpack has simple structure, good effect of shock mitigation and a timely adjustable inflation aircushion.

For attaining the above objectives, the present invention provides the technology solutions as follows.

A backpack with an intelligent automatic adjusting inflation aircushion and a pneumatic shock absorber system, which comprising: a backpack main body and a shoulder strap and back cushion; the backside of said backpack main body is installed with a back frame; said shoulder strap and back cushion is provided with said adjustable inflation aircushion; the backside of said shoulder strap and back cushion is provided with said pneumatic shock absorber system; said pneumatic shock absorber system can be movably connected with said back frame, and includes a bracket and movable cylinders provided on said bracket; said movable cylinders include a cylinder body disposed with a guiding groove, an upper cover of cylinder and an air-pouch column provided in the cylinder, said air-pouch column is surrounded around by a spring; and said adjustable inflation aircushion of said shoulder strap and back cushion is connected to said air-pouch column with a connecting vessel.

Said back frame of said backpack main body is provided with a nail hole, said upper cover of cylinder is provided with a nail, and said nail is engaged with said nail hole.

Said movable cylinders are four.

Said nail hole is arc-shaped with board bottom and narrow top.

Said nail is consisted of a nail column and a nail head, and said nail head is shaped like a sphere, a cube or a column.

The beneficial effect of the present invention are: a backpack with an intelligent automatic adjusting inflation aircushion and a pneumatic shock absorber system, which comprising: a backpack main body and a shoulder strap and back cushion; the backside of said backpack main body is installed with a back frame; said shoulder strap and back cushion is provided with said adjustable inflation aircushion; the backside of said shoulder strap and back cushion is provided with said pneumatic shock absorber system; said pneumatic shock absorber system can be movably connected with said back frame, and includes a bracket and movable cylinders provided on said bracket; said movable cylinders include a cylinder body disposed with a guiding groove, an upper cover of cylinder and an air-pouch column provided in the cylinder, said air-pouch column is surrounded around by a spring; and said adjustable inflation aircushion of said shoulder strap and back cushion is connected to said air-pouch column with a connecting vessel. Said pneumatic shock absorber system of the present invention can effectively reduce the vibration generated during the usage of the said backpack, while the smart connection between said pneumatic shock absorber system and said adjustable inflation aircushion can automatic adjust air pressure of said inflation aircushion inside said shoulder strap and back cushion according to the number of the load of said backpack. Hence, an optimum softness of said shoulder strap and back cushion is achieved and, as a result, the user will feel more comfortable and can effectively avoid the harm generated from the weight of backpack to his body.

DETAILED DESCRIPTION OF THE INVENTION

Figure 1:
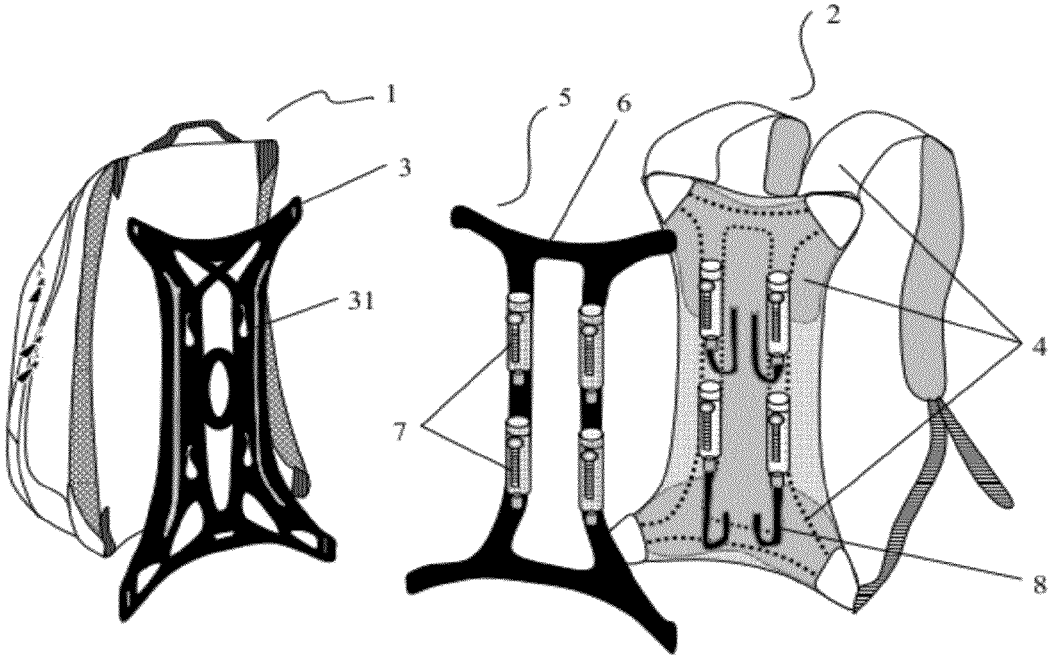
FIG. 1 is an exploded view of the present invention.

Preferred embodiments according to the present invention will now be described with reference to the Figures, in which like reference numerals denote like elements.

Figure 2:
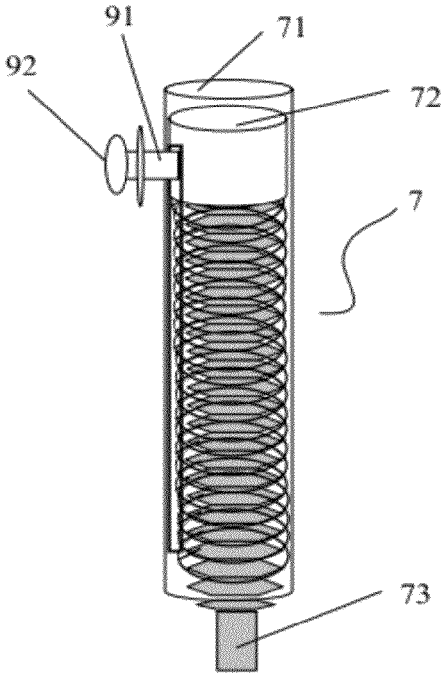
FIG. 2 is a configuration view of the movable cylinder of the present invention.
Figure 3:
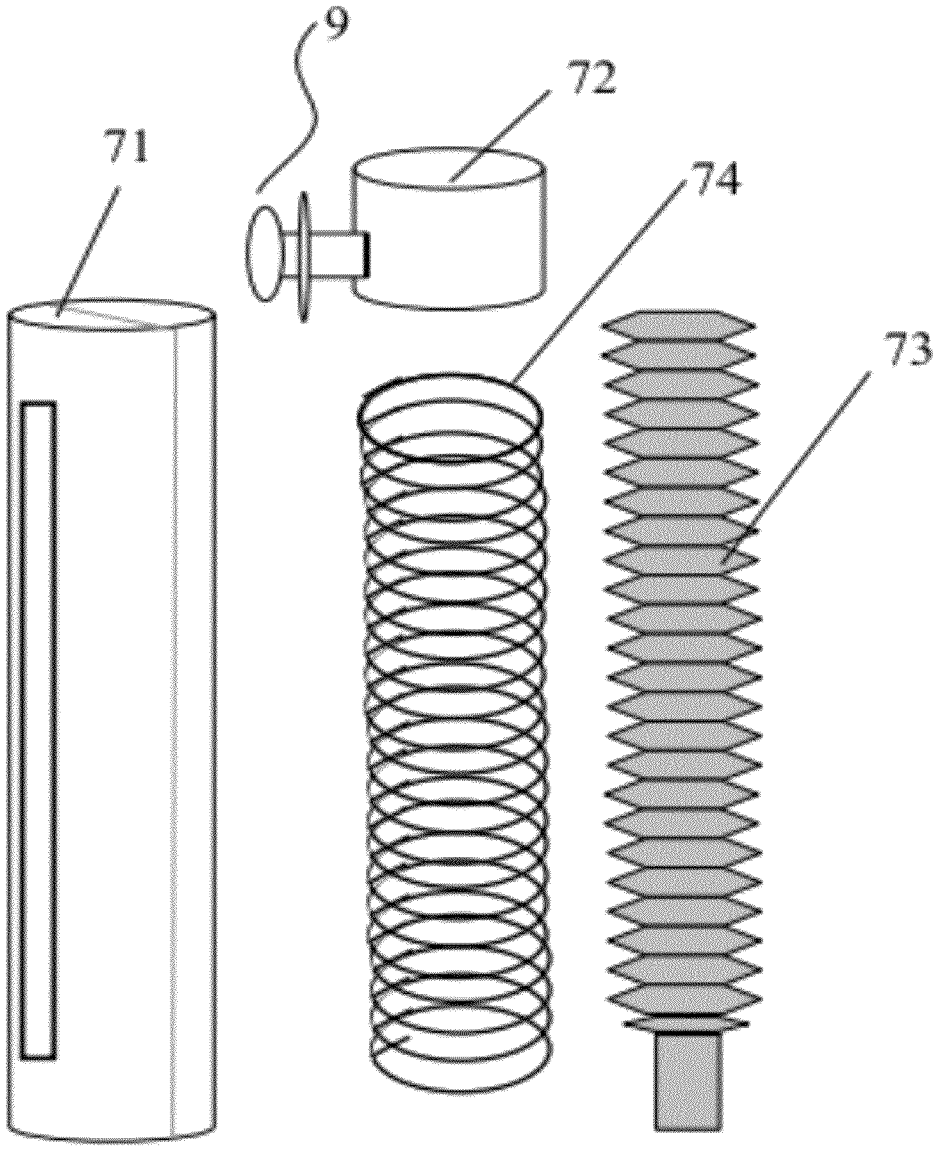
FIG. 3 is an exploded view of the movable cylinder of the present invention.
Figure 4:
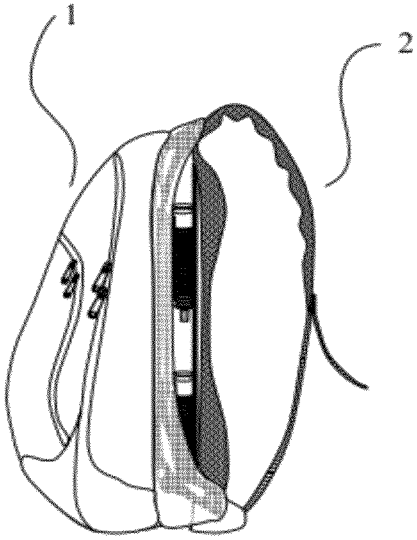
FIG. 4 is a configuration view of the present invention which is under heavy weight.
Figure 5:
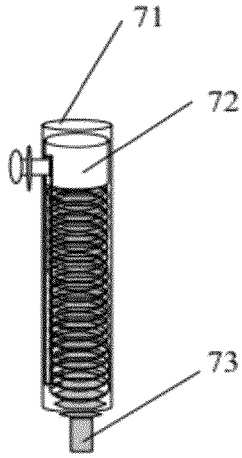
FIG. 5 is a state diagram of movable cylinder when the present invention is under heavy weight.
Figure 6:
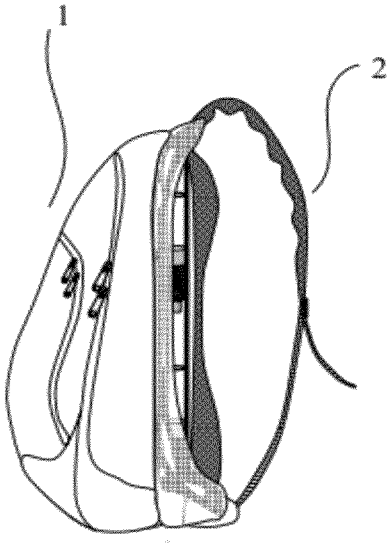
FIG. 6 is a configuration view of the present invention which is not under heavy weight.
Figure 7:
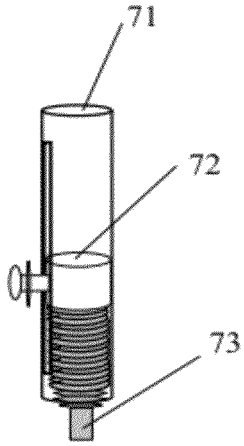
FIG. 7 is a state diagram of movable cylinder when the present invention is not under heavy weight.

As shown in FIGS. 1~6, a backpack with an intelligent automatic adjusting inflation aircushion and a pneumatic shock absorber system, which comprising: a backpack main body 1 and a shoulder strap and back cushion 2; the backside of said backpack main body 1 is installed with a back frame 3; said shoulder strap and back cushion 2 is provided with said adjustable inflation aircushion 4; the backside of said shoulder strap and back cushion 2 is provided with said pneumatic shock absorber system 5; said pneumatic shock absorber system 5 can be movable connected with said back frame, and includes a bracket 6 and movable cylinders 7 provided on said bracket 6; said movable cylinders 7 include a cylinder body 71 disposed with a guiding groove, an upper cover of cylinder 72 and an air-pouch column 73 provided in the cylinder, said air-pouch column 73 is surrounded around by a spring 74; and said adjusting inflation aircushion 4 of said shoulder straps and a back cushion 2 is connected to said air-pouch column 73 with a connecting vessel 8. Said movable cylinders 7 are four.

Said back frame 3 is provided with a nail hole 31, and said upper cover of cylinder 72 is provided with said nail 9. Said nail 9 can be buckled with said nail hole 31 movably, and thus provides convenience for removing said shoulder strap and back cushion 2 from said backpack main body 1 and installing said shoulder strap and back cushion 2 to said backpack main body 1. When the stuff packed in said backpack main body 1 have more heavy weights, said nail 9 plucks said spring 74 and said air-pouch column 73 of said movable cylinder 7 via said upper cover of cylinder 72, enabling said spring 74 and said air-pouch column 73 to stretch up and down. Because said air-pouch column 73 is connected with said adjustable inflation aircushion 4 via said connecting vessel 8, it is also a process that said adjustable inflation aircushion 4 automatic adjusts air pressure inside itself, during said spring 74 and said air-pouch column 73 stretch up and down. In this adjusting process, the present invention can be well adapted to the different extent of weight, as said pneumatic shock absorber system 5 can reduce the vibration generated during the usage of the said backpack and the comfortlessness of users, meanwhile said adjustable inflation aircushion 4 automatic adjusts air pressure inside itself timely can provide an optimum softness of said shoulder strap and back cushion 2, as a result, the user will feel more comfortable and can effectively avoid the harm generated from the weight of backpack to his body.

Said inflation aircushion can be provided with an air faucet, and said air-pouch column 73 can connect said air faucet of said inflation aircushion 4 via said connecting vessel 8.

In the actually use, various said backpack main body 1 can be optionally combined with said shoulder strap and back cushion 2 which make the users feel comfortable, in order to meet the different requirements of users, prolong the present invention's working life, cut the working costs and save social resources.

Said nail 9 is consists of a nail column 91 and a nail head 92, and said nail head 92 is shaped like a sphere, said nail head 92 is connected with said nail column 91. Said nail head 92 is bigger than said nail column 91, enabling the said nail head 92 can be buckled well in the said nail hole 31 without sliding down. Said nail head 92 also can be shaped like a cube, a column or other shapes.

In the actually manufacture, said adjustable inflation aircushion 4 of said shoulder strap and back cushion 2 can be installed in or removed from said shoulder strap and back cushion 2. When said adjustable inflation aircushion 4 starts to leak air or can not be inflated with air, said adjustable inflation aircushion 4 can be removed away and new inflation aircushion can be installed, to save social resources.

While the present invention has been described with reference to particular embodiments, it will be understood that the embodiments are illustrative and that the invention scope is not so limited. Alternative embodiments of the present invention will become apparent to those having ordinary skill in the art to which the present invention pertains. Such alternate embodiments are considered to be encompassed within the spirit and scope of the present invention. Accordingly, the scope of the present invention is described by the appended claims and is supported by the foregoing description.

What is claimed is:

1. A backpack with an intelligent automatic adjusting inflation aircushion and a pneumatic shock absorber system, comprising: a backpack main body and a combined shoulder strap and back cushion, wherein:

a backside of said backpack main body includes a back frame;

said combined shoulder strap and back cushion is provided with said adjustable inflation aircushion;

a backside of said combined shoulder strap and back cushion is provided with said pneumatic shock absorber system;

said pneumatic shock absorber system can be movably connected with said back frame, and includes a bracket and movable cylinders provided on said bracket;

said movable cylinders include a cylinder body disposed with a guiding groove, an upper cylinder cover and an air-pouch column provided in the cylinder, said air-pouch column is surrounded by a spring; and said adjustable inflation aircushion of said combined shoulder strap and back cushion is connected to said air-pouch column with a connecting vessel.

2. The backpack according to claim 1, wherein said back frame of said backpack main body is provided with a nail hole.

3. The backpack according to claim 2, wherein said upper cylinder cover is provided with a nail, and said nail is engaged with said nail hole.

4. The backpack according to claim 1, wherein said movable cylinders are four.

5. The backpack according to claim 2, wherein said nail hole is arc-shaped with a broad bottom and narrow top.

6. The backpack according to claim 3, wherein said nail is consisted of a nail column and a nail head, and said nail head is shaped like a sphere, a cube or a column.

* * * * *